United States Patent [19]

Shirahase et al.

[11] 4,162,787

[45] Jul. 31, 1979

[54] SHEET SORTING DEVICE

[75] Inventors: Reiji Shirahase, Tokyo; Shigehiro Komori, Yokohama, both of Japan

[73] Assignee: Canon Kabushiki Kaisha, Tokyo, Japan

[21] Appl. No.: 897,055

[22] Filed: Apr. 17, 1978

Related U.S. Application Data

[63] Continuation of Ser. No. 754,171, Dec. 27, 1976, abandoned, which is a continuation of Ser. No. 612,723, Sep. 12, 1975, abandoned.

[51] Int. Cl.[2] ..... B65H 31/24

[52] U.S. Cl. ..... 271/173

[58] Field of Search ..... 271/64, 173; 270/58

[56] References Cited

U.S. PATENT DOCUMENTS

| | | | |
|---|---|---|---|
| 313,761 | 3/1885 | Palmer | 271/173 |
| 3,774,902 | 11/1973 | Schulze | 271/173 |
| 3,788,640 | 1/1974 | Stemmle | 271/173 |
| 3,802,694 | 4/1974 | Post et al. | 271/173 |
| 3,848,868 | 11/1974 | Stemmle | 271/173 |
| 3,866,904 | 2/1975 | Stemmle | 271/173 |
| 3,977,667 | 8/1976 | Cross et al. | 271/173 X |
| 3,995,748 | 12/1976 | Looney | 271/173 X |

*Primary Examiner*—Robert W. Saifer

*Attorney, Agent, or Firm*—Fitzpatrick, Cella, Harper & Scinto

[57] ABSTRACT

A sheet sorting device for use with a copying machine, a simple printing machine, etc., which comprises a tray housing having a plurality of oscillatable trays, support means for the tray housing, moving means for displacing the support means so as to cause each of the trays in the tray housing to be positioned at a sheet introducing position, and control the moving means, the tray housing being progressively displaced to position the trays successively at the sheet introducing position so that the sheets may be introduced into predetermined ones of the trays.

4 Claims, 11 Drawing Figures

SHEET SORTING DEVICE

This is a continuation of application Ser. No. 754,171, filed Dec. 27, 1976, and now abandoned which in turn is a continuation of Ser. No. 612,723, filed on Sept. 12, 1975, now abandoned.

BACKGROUND OF THE INVENTION

1. Field of the Invention

This invention relates to a sheet sorting device for use with copying machines, or simple printing machines, etc.

2. Description of the Prior Art

In reproducing a plurality of sets of copies from a document containing a number of pages by the use of an electrophotographic copying machine, or a simple printing machine, etc. the reproduced copies of the document must be placed one over another in the order of page numbers for each set. This so-called collation requires much labor and time, and errors often result from the collative work.

In ordinary reproducing or printing machines, as a desired number of copies of a page are continuously reproduced, and subsequently pages are also reproduced repeatedly, in this manner, there inevitably occurs a condition wherein the reproduced copies of the same pages are stacked page-wise. This gives rise to necessity for rearranging the reproduced copies in the order of the page numbers to form a required numbers of sets of reproduced documents, and the placing of these sets separately on a shelf or other appropriate means so that they may be taken out individually set by set. This is the so-called collation work.

To meet such requirements, there has heretofore been proposed a device which automatically sorts the documents immediately following the copying or printing operation, although such type of sheet sorting device has not yet been designed in a very compact and simple unit.

SUMMARY OF THE INVENTION

It is therefore an object of the present invention to provide a compact sheet sorting device.

It is another object of the present invention to provide a simple sheet sorting device.

It is still another object of the present invention to provide a sheet sorting device which permits a tray casing to be removed therefrom.

It is yet another object of the present invention to provide a sheet sorting device which permits a tray casing containing therein any desired number of trays to be used therewith.

It is a further object of the present invention to provide a sheet sorting device capable of increasing the intertray spacing by the utilization of a sector cam.

It is still further object of the present invention to provide a sheet sorting device, in which trays are downwardly inclined with respect to moving direction of the sheets.

It is other object of the present invention to provide a sheet sorting device, in which trays are upwardly inclined with respect to moving direction of the sheets and, at the same time, a required spacing between one tray and another immediately above it is secured for the sheets to be readily introduced into the tray. Since the upwardly inclined tray construction presupposes the necessity that a riser part for preventing the sheets from slipping down be provided on the side of the sheet introduction, the need for widening the spacing between one tray and another immediately above it becomes far greater than in the downwardly inclined tray construction.

It is still other object of the present invention to provide a sheet sorting device, in which the spacing between one tray and another immediately above it is broadened to facilitate removal of the sheets from the tray. For this purpose, a foot switch is utilized to lower the level of the tray casing independently of a signal from the body of the copying machine to thereby increase the spacing between the neighboring trays stage by stage to permit removal of the sheets. During the removal of each sheet, as each tray stays, at the same position where the introduction of the sheets has been effected, the sheet can be removed from the same level, which is very convenient, in the sheet handling operation.

Thus, the present invention has modified the conventional large-scale sorting device into a compact structure, and, at the same time, improved its handling by a simple operation, the features of which may be summarized as follows:

1. The tray casing is a simple construction comprising a plurality of trays and a casing to accommodate the trays therein, which is readily removable from a table and permits reproduced copies to be conveyed to other spot as they are placed in the tray casing.

2. In accordance with the number of sets of copies to be reproduced, tray casings containing a small number of trays are prepared in advance, and a plurality of such tray casings may be stacked in some stages for the use.

3. The inter-tray spacing may be increased only at the time of introducing the sheets by a simple mechanism utilizing a sector cam.

4. Since the tray is subjected to movement by the sector cam, the sheets can be neatly arranged in the trays.

The above explanations refer to a case where a tray is displaced every time one sheet is introduced thereinto. In some other cases, however, it will be desired to introduce a number of sheets into each tray by displacing the trays one after the other. In such cases, it is possible to design the apparatus in the manner such that the operational sequence may be changed by switching over a control circuit so that a tray is displaced when a predetermined number of copies have been reproduced. This system will be particularly useful when number of original image format sheets are successively copied by an automatic feeder to reproduce a large number of sets of the originals. Such mode of use will also be suitable when the reproduced copies of the originals, upon its sorting into one set, are continuously passed through a collator, a folder and a binding machine for bookbinding.

The foregoing objects and other objects as well as the actual construction and function of the present invention will become more fully apparent from the following detailed description taken in conjunction with the accompanying drawings.

DESCRIPTION OF THE PREFERRED EMBODIMENTS

Figure 1:
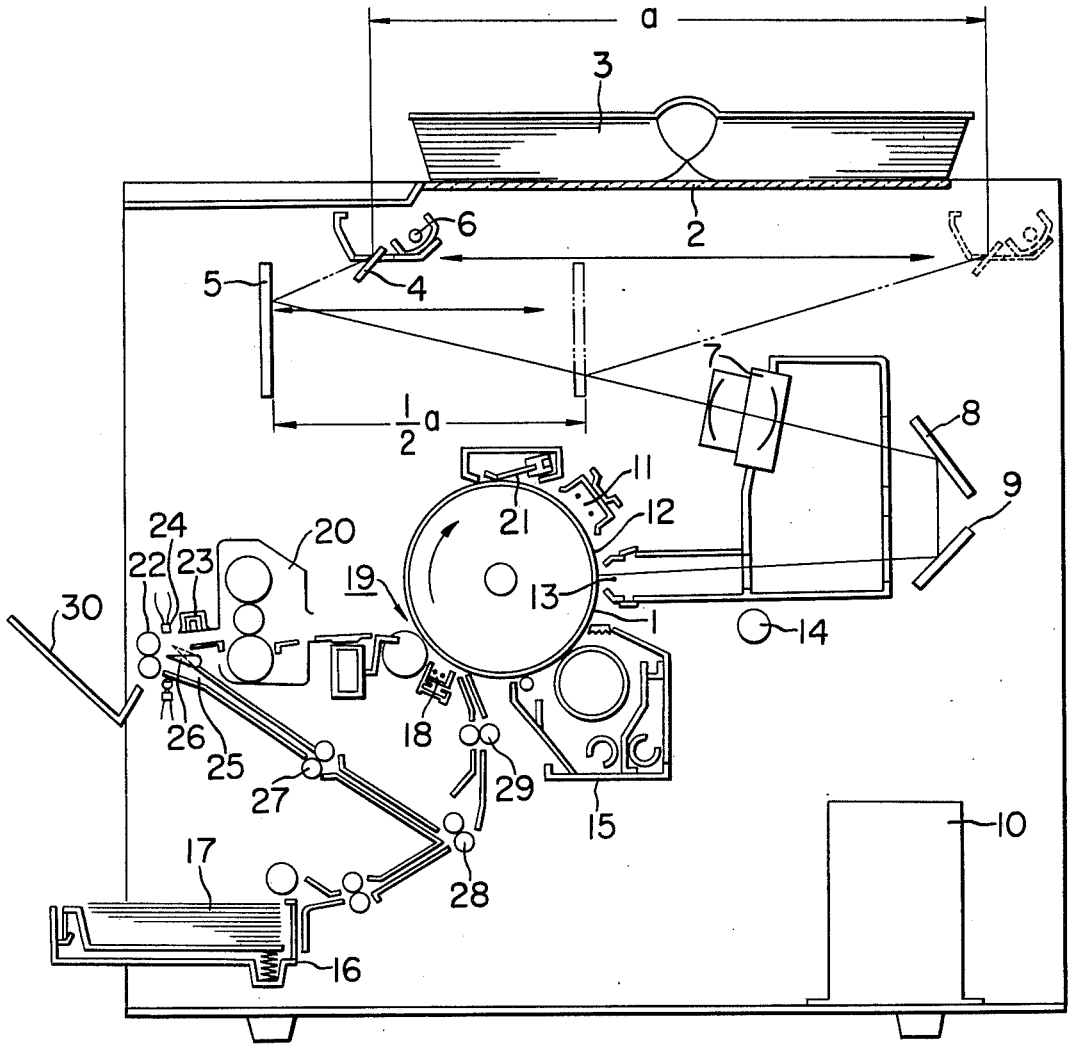
FIG. 1 is a cross-sectional view of an example of a copying machine, to which the sheet sorting device according to the present invention can be attached.

Referring to FIG. 1, which shows one example of the copying machine to be associated with the sorting device of the present invention, an original 3 is placed on the transparent plate 2 of an original stand, and is focussed on a photosensitive drum 1 by means of an optical system constructed with movable mirrors 4 and 5, a lens 7, and stationary mirrors 8 and 9. In more detail, the original 3 is subjected to slit-exposure or scanning by the movable mirror 4 which moves in association with an illuminating lamp 6, and the movable mirror 5 which moves in the same direction as that of the movable mirror 4, but at a moving speed half this mirror 4, to maintain the length of its light path constant, and the image of the original is focussed onto a drum 1 through the lens 7, the stationary mirrors 8 and 9 and a slit.

Incidentally, the electrophotographic copying machine as exemplified herein is of the image transfer type, in which a stationary stand for an original image is adopted, and which is capable of easily copying even thick or three-dimensional originals.

The surface of the drum 1 comprises a photosensitive medium having a photosensitive layer covered with a transparent insulating layer. The photosensitive medium is first charged to the positive polarity by a positive (+) charger 11, to which a positive high voltage from a high voltage source 10 is supplied. Subsequently, when the drum 1 reaches an exposure station 12, the original 3 on the transparent plate 2 of the original stand is illuminated by the illuminating lamp 6 and focussed on the drum 1 through the movable mirrors 4 and 5, the lens 7, and the stationary mirrors 8 and 9. The photosensitive medium, simultaneously with the exposure thereon of the original image, is subjected to AC discharge by an AC discharger 13, to which a high AC voltage is supplied from the high voltage source 10.

Next, the photosensitive medium is subjected to overall exposure by an overall exposure lamp 14 to form an electrostatic latent image on the surface thereof, after which the photosensitive medium shifts into developing device 15.

The electrostatic latent image is developed into a visible image by the powder development technique of the magnetic sleeve type.

A sheet of copy paper 17 fed out of a cassette 16 is then brought into intimate contact with the drum 1. The copy sheet is charged to the positive polarity by a transfer charger 18, and the image on the drum 1 is transferred onto the copy sheet.

After the image transfer, the copy sheet is separated from the drum 1 by a separating portion 19 and directed to a fixing portion 20. On the other hand, the surface of the drum (photosensitive medium) is cleaned by a blade 21 urged thereagainst to remove any residual toner on the drum so that it may be reused in the subsequent cycle.

The present embodiment is also capable of effecting image reproduction on both sides of the copy sheet in a simply manner. That is, the paper conveyor system in this embodiment is designed such that a copy sheet with one surface thereof having been already printed is not discharged out of the machine, but is again directed to the image transfer device for the back surface to be printed. More specifically, the copy sheet which, during one-surface printing, has passed through the fixing device 20, has been conveyed by paper discharging rollers 22, and is advancing while discharging excess electric charge by a discharger 23, is detected by a light-receiving element 24 for passage of the rear edge thereof, and is directed to a path 25 for back-side printing by reverse rotation of the paper discharge rollers 22. Concurrently with the reverse rotation of the paper discharge rollers 22, a guide plate 26 is displaced to a position where the copy sheet is guided to a path 25, and the copy sheet is stopped near register rollers 29 by conveyor rollers 27 and 28.

Subsequently, the copy sheet is brought to the back-side printing cycle, during which the copy sheet is again fed into the image transfer device by a paper feed signal, while undergoing the control of the register rollers 29. Upon completion of the image transfer, the copy sheet is again passed through the fixing device 20 and the discharger 23, and delivered into a tray 30 by the paper discharge rollers 22.

Figure 2:
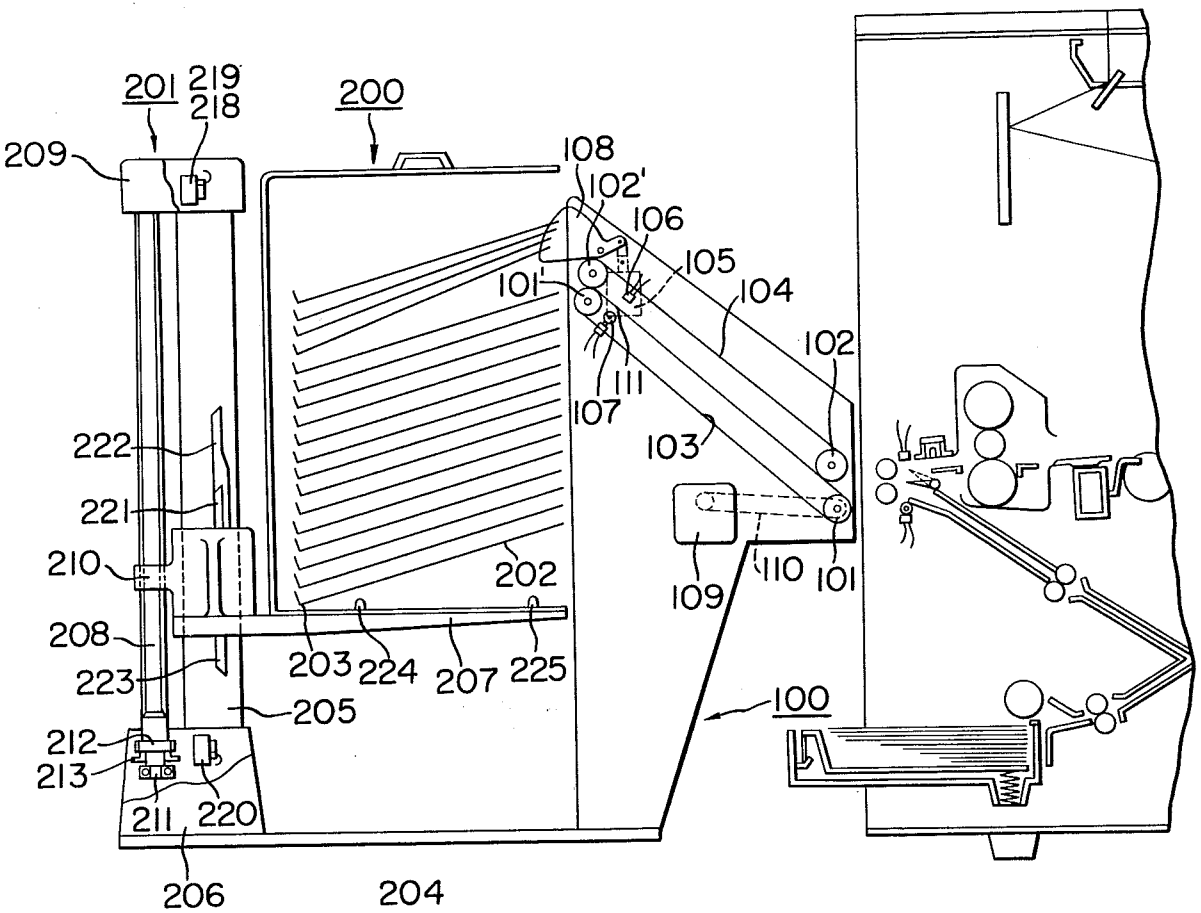
FIG. 2 is a cross-sectional view showing the sheet sorting device of the present invention connected to the copying machine of FIG. 1.
Figure 3:
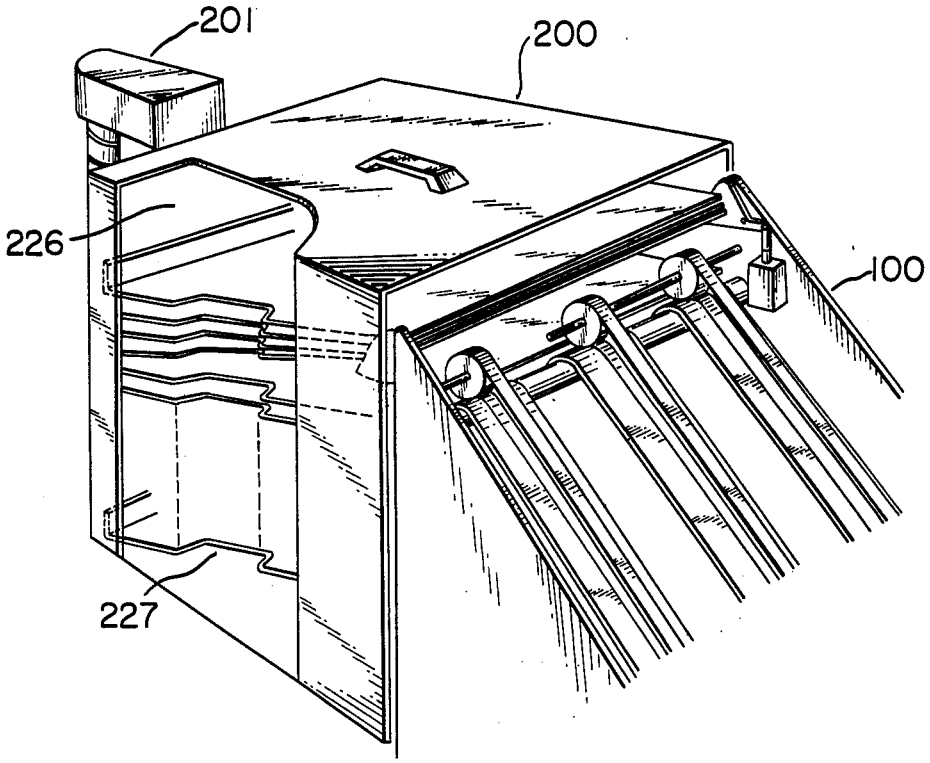
FIGS. 3, 4, 5 and 6 are enlarged views of the principal portions of the device according to the present invention.
Figure 6:
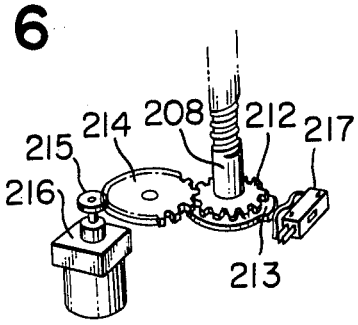

FIG. 2 shows one embodiment of the sorting device of the present invention in its state of being connected to the copying machine of FIG. 1, in which the tray 30 as mentioned above is removed from the machine. Referring now to FIGS. 2, 3 and 6, the sorting device comprises an introducing section 100, a tray casing 200, and means 201 for vertically moving the tray casing. The introducing section 100 is to introduce copies discharged from the copying machine into the sorting device, the entrance level of which is adapted to meet the level of the discharge outlet of various copying machines. A copy sheet discharged by a conveyor device comprising a pair of rollers 101, 101', a belt 103, another pair of rollers 102, 102' and another belt 104, is moved to the entrance of the tray casing, while being sandwiched between the belts 103 and 104. The roller 101 is driven by a geared motor 109 through a chain 110, and kept rotating during the operation of the copying machine.

The tray casing 200 contains therewithin a number of trays 202, each being slightly pivotable about a hinge 203 and capable of containing therein a number of copy sheets. Since the number of copy sheets to be contained in the tray is determined by the inter-tray spacing, a suitable number of trays are arranged at suitable space intervals.

The tray casing lifting means 201 basically comprises a strut 205 vertically erected on a base plate 204 by a support bed 206, and a feed screw 208 rotatably supported between the support bed 206 and a cap 209 by means of bearings 211. The tray casing lifting means also includes table 207 to be vertically guided by the strut.

The tray casing 200 is freely mountable on and dismountable from the table 207, and can easily be fitted by positioning dowels 224 and 225.

The table 207 is coupled by a nut 210 with the feed screw 208 which may be rotated in normal or reverse direction by a reversible geared motor 216 through a pinion 215, an idler 214 and a gear 212, whereby it is vertically movable.

Now, if a document consisting of n sheets of originals is to be copied to reproduce m sets of copies, the first sheet of the originals is set on the copying machine and a copy number setting device is set to m, after which the copying operation is started. At this time, the table 207 is at its uppermost position with the lowermost tray being located above the copy-receiving position. Simultaneously with commencement of the copying operation, the table 207 is slightly lowered to bring the lowermost tray down to the copy-receiving position and stop it there. A first copy sheet comes into that tray and, when the rear edge of this copy sheet passes through a detector portion 111 comprising a lamp 107 and a light-receiving element 106, the geared motor rotates in the normal direction to rotate the feed screw 208 in the same normal direction, thereby lowering the table 207 by an amount corresponding to one stage of the tray (hereinafter called "one pitch").

In the same way, the second copy sheet is received into a second tray from the bottom. The lead for the feed screw 208 is set equally to the tray pitch so that, when a cam 213 secured to the feed screw 208 performs one revolution to actuate a microswitch 217 again, the geared motor 206 is stopped, and, by that time, the table 207 can moved by one pitch.

When the copying machine thus enters into the reproduction cycle of the mth copy sheet, there is produced a stop signal for preventing the next copy cycle (i.e. for the m+1th copy sheet) from starting. By this signal, the control circuit for the geared motor 216 is switched over to the reverse rotation mode. When the rear edge of the mth copy sheet passes through the detector portion 111, the geared motor 216 starts its reverse rotation to rotate the feed screw 208 in the reverse direction, whereby the table 207 is lifted by the reverse rotation of the feed screw 208 to its uppermost position, and stopped there.

Then, the first original is replaced by the second original to start copying, whereby copy sheets will likewise be distributed one by one onto successive trays commencing with the lowermost one. In this manner, upon completion of copying, the nth original, the m sets of copy sheets, each consisting of n copy sheets are respectively stacked in the trays. These stacked copies are removed through an outlet 226, as shown in FIG. 3, and removal of which can be done easily by a notched portion 227 formed in each tray to permit ready grip of the copies.

Reduction in size of the sorting device will of course presuppose the reduction in size of the tray casing. This will in turn involve the need to reduce the inter-tray spacing, which apparently depends on number of the copy sheets to be placed in each tray. This spacing, however will have to be increased, when additional copy sheet or sheets are to be introduced onto the stacked sheets in the tray. Therefore, increase in the inter-tray spacing or the width of the tray entrance, only when a copy sheet is introduced into the tray is important in reducing the size of the entire tray casing. Such idea has already been proposed by one of the present inventors.

Figure 4:
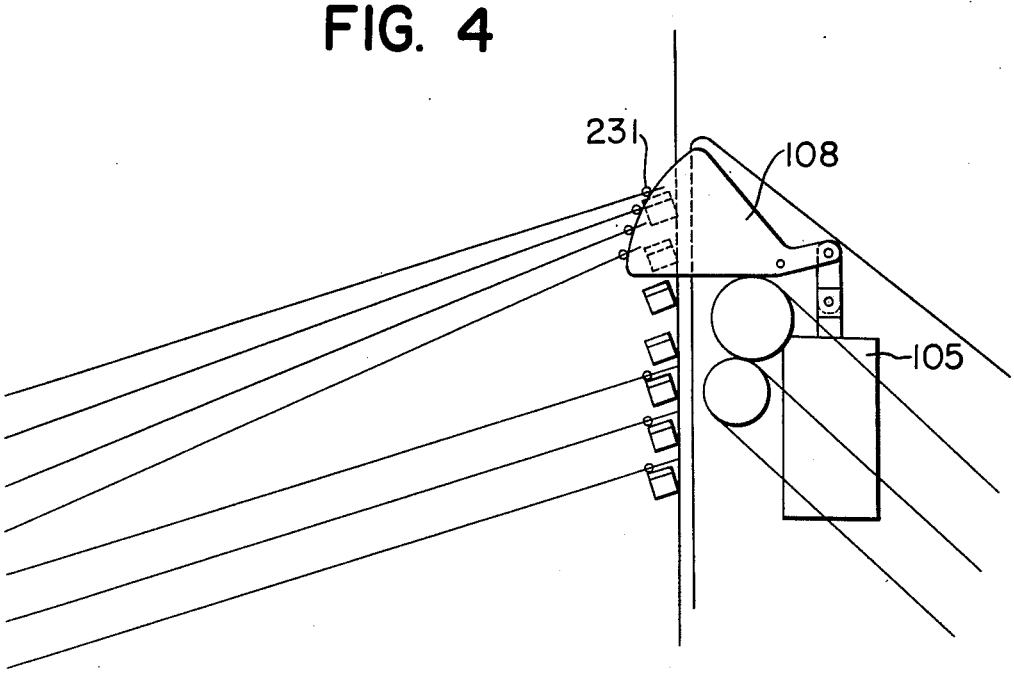
Figure 5:
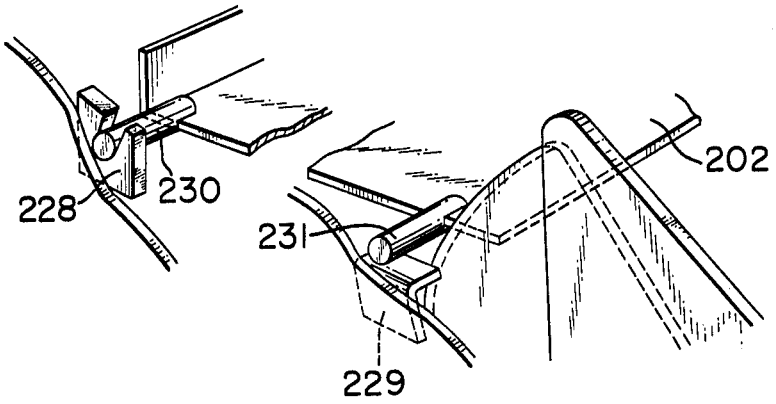

In the present embodiment, as shown in FIGS. 4 and 5, each tray 202 is pivotable about the hinge 203 by a design in which a hinge bearing 228 and a metal bracket 229 support a hinge shaft 230 and a pin 231, respectively.

When a tray comes close to the sheet receiving position, the sector cam 108 contacts the pin 231. Every time the table is lowered, the position of the tray relative to the tray casing is displaced upwardly, and, one pitch before the sheet receiving position, the pin of a tray which is one-stage lower than that at the sheet receiving position is disengaged from the sector cam and drops onto the position of the metal bracket 229, whereby the spacing between the tray at the sheet receiving position and that which is one stage is broadened. At this time, the tray which is one stage lower is situated at the sheet receiving position. As the table is displaced by one pitch, the pin of that tray is disengaged from the sector cam and drops onto the metal bracket 229 to assume the sheet receiving position, whereby the spacing between the tray at the sheet receiving position and that which is one stage higher becomes widened.

In this manner, when the mth copy sheet is completely received, the table 207 is lifted by reverse rotation of the geared motor 216 as already mentioned, and, by the same signal, the solenoid 105 is energized to displace the sector cam 108 from its operative position.

Upon arrival at its uppermost position, the table 207 is stopped thereby the microswitch 218 which has been actuated by an actuator 221, and the signal produced thereby switches over the control circuit for the geared motor 216 back to the normal rotation mode, whereby the solenoid 105 is deenergized to return the sector cam 108 to its operative position. As already mentioned, the table 207 starts lowering by the copy-start signal and continues its lowering because, at this position, a microswitch 219 is in an actuated state by the actuator 222, and the operation of the microswitch 217 is independent of the operation of the microswitch 219. (The microswitch 219 is fitted beneath the microswitch 218 in an overlapping relationship therewith). Just before the lowermost tray reaches the sheet receiving position, the microswitch 219 is deactuated, so that the table 207 is stopped by the microswitch 217 when the lowermost tray is brought to the sheet receiving position. Thus, a first copy of the next original is introduced into the lowermost tray and the second tray from the lowermost or bottom is raised by the sector cam 108 to thereby widen the spacing at the introducing part.

Upon arrival of the table 207 at its lowermost position, a microswitch 220 is actuated by an actuator 233 to switch over the control circuit of the geared motor 216 to the reverse rotation mode, thereby lifting the table 207. This microswitch 220 also prevents the table 207 from excess movement.

The uppermost position of the table 207 is ordinarily its rest or stoppage position, at which mounting and dismounting of the table 207 may be done. In this position, as the table is released from contact with the sector cam, such mounting and dismounting are facilitated.

Figure 7:
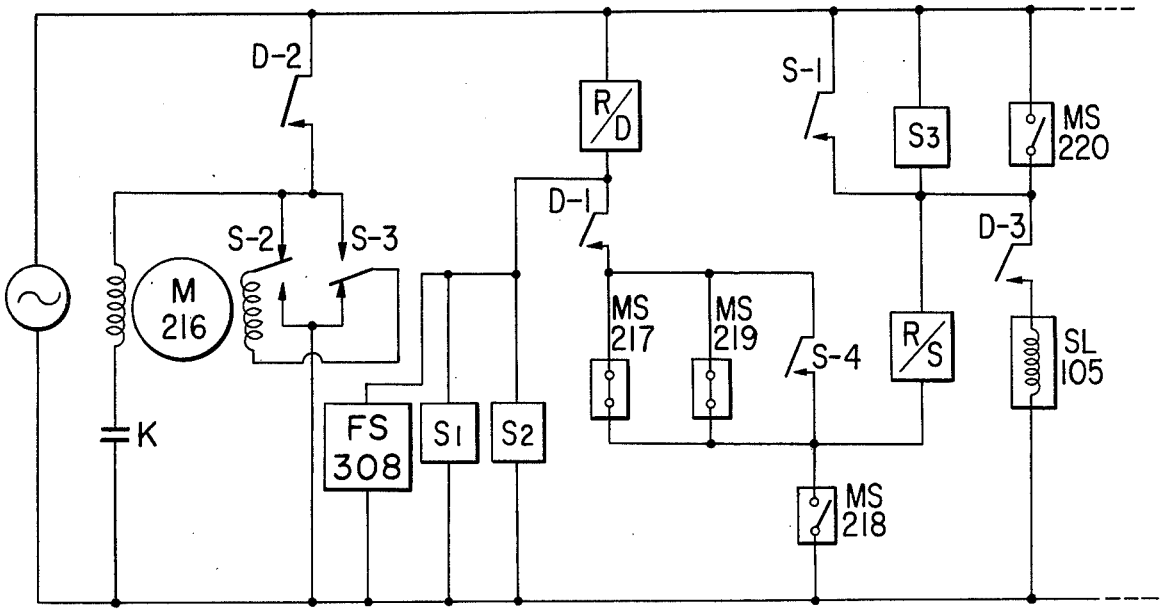
FIG. 7 is a connection diagram of the electric control circuit.
Figure 8:
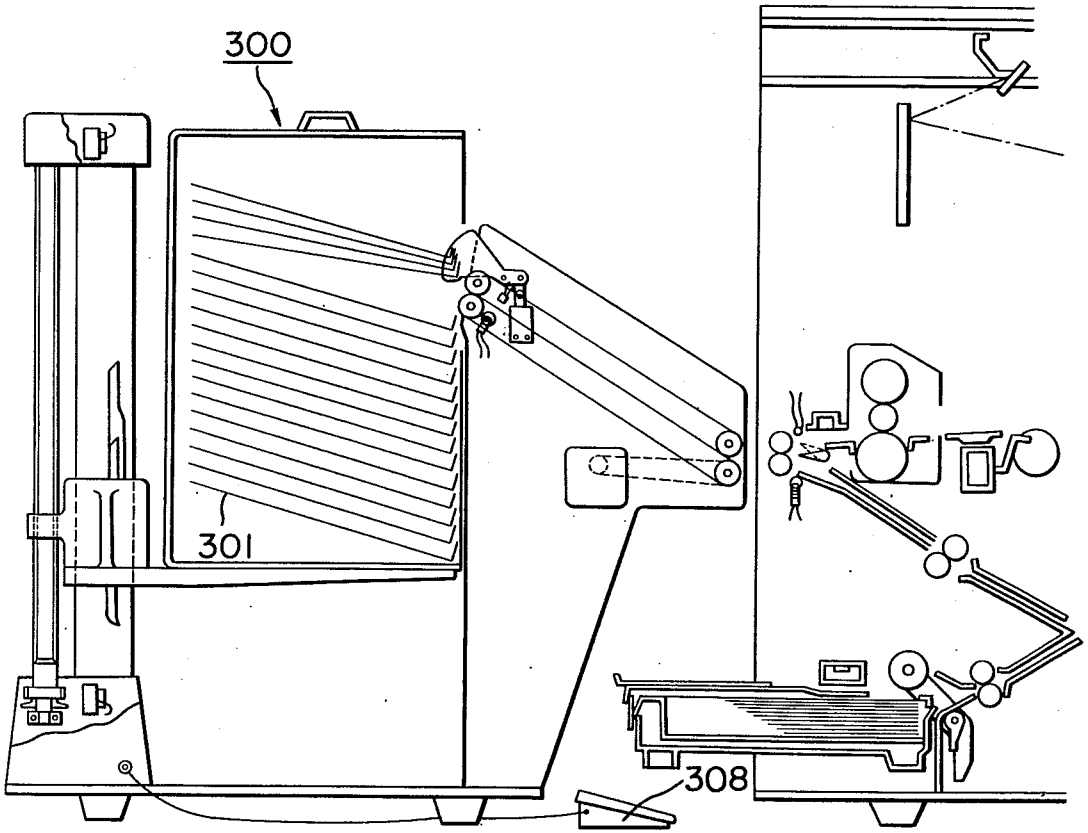
FIG. 8 is a cross-sectional view showing another embodiment of the present invention connected to the copying machine of FIG. 1.
Figure 9:
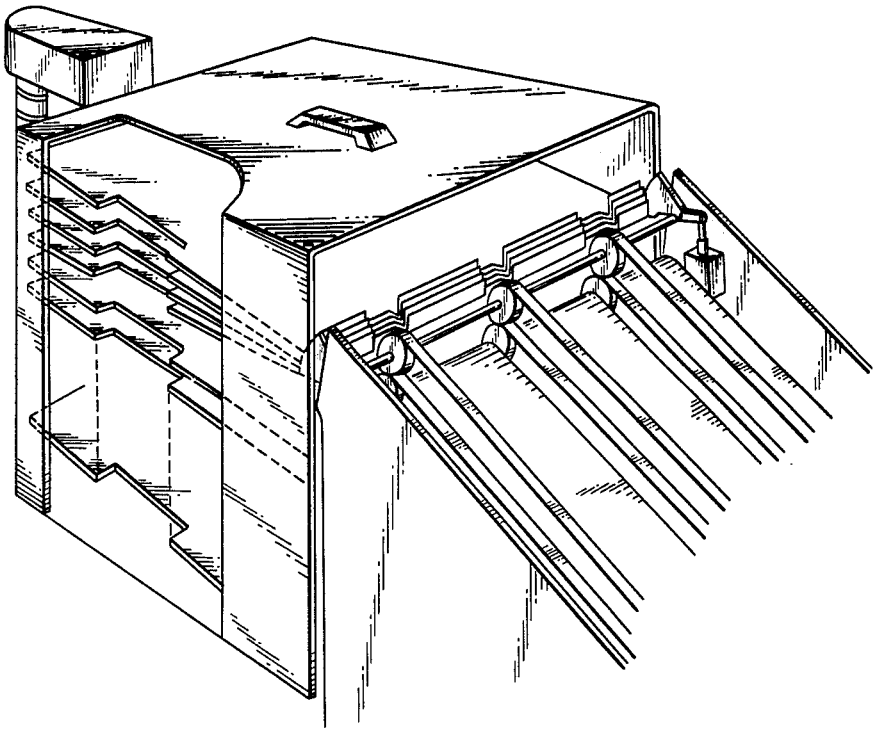
FIGS. 9, 10 and 11 are enlarged views of the principal portions of the device according to the present invention shown in FIG. 8.
Figure 11:
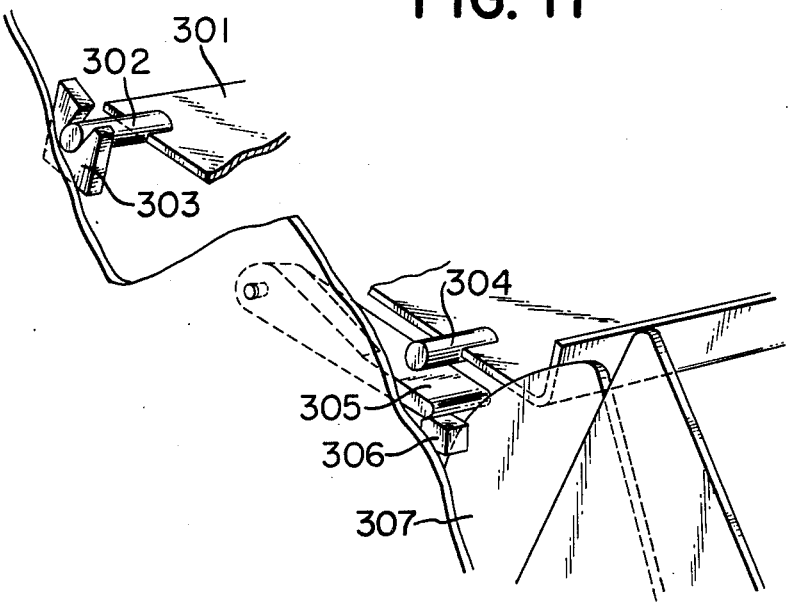
Figure 10:
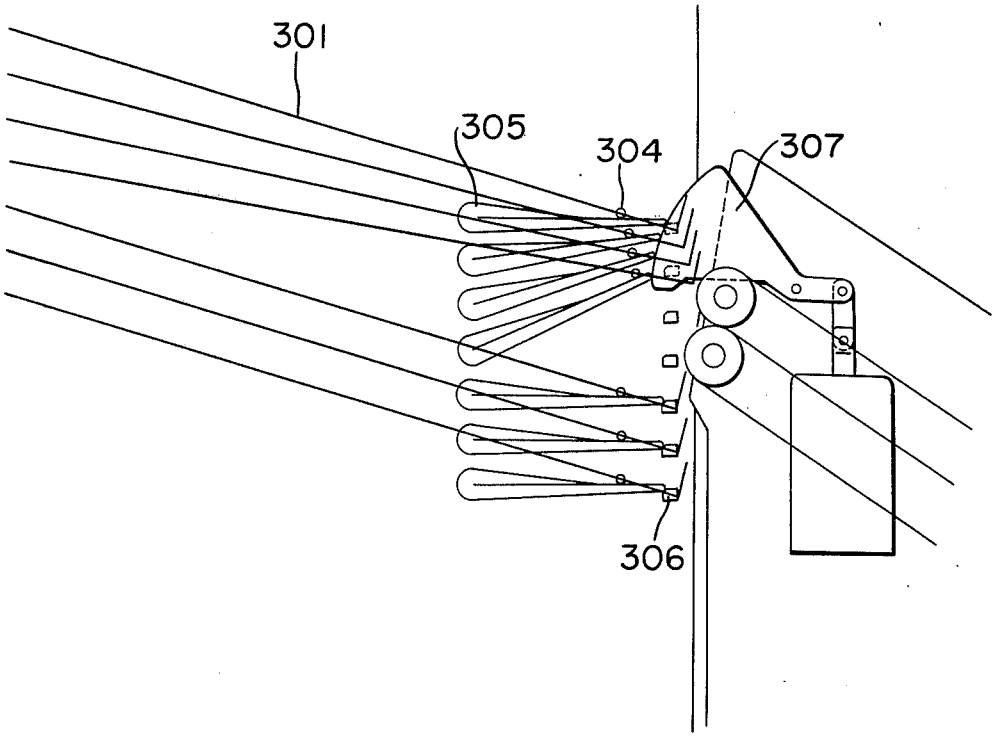

FIG. 7 shows an example of the electric control circuit. This electric circuit is to manage the vertical movement of the table 207, which is the main function of the present device, and other accessory circuits are not shown. The circuit diagram shows a state, wherein the table 207 is stopped at its uppermost position, with the microswitch 218 being actuated. In the drawing there are seen microswitches MS, a motor M, a capacitor K, a solenoid SL, a driving relay R/D, a switching relay R/S, relay contacts D-1, D-2, D-3, S-1, S-2, S-3, S-4, and signals S1, S2 and S3 from other electric circuits.

The driving relay R/D is energized by the copy start signal S1 to close its contact D-1 for self-sustaining, while, at the same time, the microswitch MS218 is released for closure, which in turn, closes the relay contact D-2, whereupon the motor M216 starts its normal rotation to lower the table 207.

Immediately before the lowermost tray reaches the sheet receiving position, the microswitch MS219 is opened, and when that tray reaches the sheet receiving position, the microswitch MS217 is actuated to open, thereby stopping the table 207.

When the first copy sheet is introduced into the lowermost tray, and the driving relay R/D is energized by the signal S2 from the detector section 111 to close the relay contacts D-1, and D-2, the motor M216 rotates normally to lower the table 207 by one pitch whereupon the microswitch MS217 is actuated to open, thereby stopping the table.

Then, at the reproduction cycle of the mth copy, when the stop signal S3 is produced, the switching relay R/S is energized to close its contact S-1 for self-sustaining, while the relay contacts S-2 and S-3 are switched over to render the motor control circuit to the reverse rotation mode, whereby the contact S-4 also closes. When the mth copy sheet passes through the detector section 111, the signal S2 is produced to energize the driving relay R/D to close its contacts D-1 and D-2, whereby the rotation of the motor M216 is reversed, and the table 207 lifts up. At this time, the solenoid SL105 is energized due to closure of the contact D-3, and the sector cam 108 is displaced from its operative position during the upward movement of the table 207. As soon as the table 207 returns to its uppermost position, the microswitch MS218 is actuated to open, thereby deenergizing the relays R/D and R/S to stop the table.

FIGS. 8 to 11 show another embodiment of the present invention. Within a tray casing 300, there are arranged a plurality of trays 301, each of which is upwardly inclined and has one end pivotally supported by a hinge shaft 302 and a hinge receiver 303, and the other end supported by a metal bracket 306 with a pin 304 and a lever 305 interposed therebetween.

As the tray casing 300 is lowered to bring the next lower tray near the copy sheet introducing position, the lever 305 comes into contact with the sector cam 307 so that the tray 301 is upwardly displaced relative to the tray casing 300 by means of the pin 304, thereby widening the spacing between that tray and the next lower tray.

All the other actions including the vertical movement of the tray casing 300 are similar to those in the previous embodiment.

A foot switch FS308 is connected to the means for vertically moving the tray casing, the electrical connections of which are as shown in FIG. 7.

Upon completion of copying, the tray casing is normally stopped at its uppermost position with the distributed copy sheets accommodated therein. When the foot switch is depressed for taking out the copy sheets, the tray casing is lowered until the lowermost tray comes to the sheet receiving position, whereupon it stops, and the spacing between the lowermost tray and the next upper tray becomes widened. With the tray casing at this position, removal of the copy sheets may be done by depressing the foot switch sequentially to lower the tray casing stage by stage.

After the copy sheets have all been removed, when the foot switch is continuously depressed, the tray casing is lowered to its lowermost position. When the microswitch MS220 is depressed to rotate the motor inversely, the tray casing moves upward. After completion of the climbing up, when the foot switch is released, the tray casing is stopped at its uppermost (rest) position.

Although, in the foregoing, the present invention has been described with reference to preferred embodiments thereof, it should be noted that they are merely illustrative and not restrictive, and that any change and modification may be made without departing from the spirit and scope of the invention as recited in the appended claims.

What is claimed is:

1. A sheet sorting device for collecting sheets supplied from a fixed discharge opening, comprising:

a tray casing, and a plurality of trays for receiving sheets thereon, wherein each of said trays is mounted at a first edge thereof for pivotal movement, and wherein said sheets are received at a second edge of said trays, said first and second edges being opposed to each other and said trays slanting upwardly toward said first edges thereof;

a plurality of displacement transmission means pivotally mounted on said tray casing for respective engagement with said trays;

means for moving said tray casing to successively align each tray with said fixed discharge opening; and control means for pivoting a plurality of said displacement transmission means to pivotally move a plurality of said trays, simultaneously, to widen the space between the second edges of adjacent trays at the sheet inlet opening for each tray, as each said tray is successively aligned with the fixed discharge opening.

2. A sheet sorting device according to claim 1, wherein a cut-away portion for taking out sorted sheets delivered on each of said trays is formed at a lateral side of said tray casing.

3. A sheet sorting device according to claim 2, wherein said control means includes switch means for vertically moving said tray casing to permit removal of the sheets therefrom.

4. A sheet sorting device according to claim 1, wherein displacement of said tray casing causes a portion of each of said trays to drop downward by its own gravitational force, stage by stage, to widen the sheet receiving openings for said trays.

* * * * *

UNITED STATES PATENT AND TRADEMARK OFFICE

CERTIFICATE OF CORRECTION

PATENT NO. : 4,162,787

DATED : July 31, 1979

INVENTOR(S) : Reiji Shirahase, et al.

It is certified that error appears in the above—identified patent and that said Letters Patent is hereby corrected as shown below:

Column 1, Line 25, change "subsequently" to --subsequent--;

Column 1, Line 30, change "numbers" to --number-- second occurrence

Column 2, Line 6, change "other" to --another--;

Column 2, Line 28, change "other" to --another--;

Column 4, Line 7, change "simply" to --simple--;

Column 5, Line 30, after "can" insert --be--;

Column 5, Line 57, after "on" insert --the--;

Column 6, Line 13, after "stage" insert --lower--;

Column 6, Line 49, change "233" to --223--;

UNITED STATES PATENT AND TRADEMARK OFFICE

CERTIFICATE OF CORRECTION

PATENT NO. : 4,162,787

DATED : July 31, 1979

INVENTOR(S) : REIJI SHIRAHASE, ET AL.

It is certified that error appears in the above-identified patent and that said Letters Patent are hereby corrected as shown below:

On the cover page of the patent below the entry marked "[22]" please insert the following:

--[30] Foreign Application Priority Data

Sept. 20, 1974 [JP] Japan .....50-24379--

Signed and Sealed this

Eighteenth Day of November 1980

[SEAL]

*Attest:*

SIDNEY A. DIAMOND

*Attesting Officer*

*Commissioner of Patents and Trademarks*